US008707846B2

(12) United States Patent
Kohnen

(10) Patent No.: US 8,707,846 B2
(45) Date of Patent: Apr. 29, 2014

(54) WEAPON WITH RECOIL AND BRAKING DEVICE, DAMPING THIS RECOIL

(75) Inventors: Norbert Kohnen, Viersen (DE); Anke Hasenkox, legal representative, Viersen (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 306 days.

(21) Appl. No.: 13/101,804

(22) Filed: May 5, 2011

(65) Prior Publication Data

US 2012/0132059 A1 May 31, 2012

Related U.S. Application Data

(63) Continuation-in-part of application No. PCT/EP2009/007330, filed on Oct. 13, 2009.

(30) Foreign Application Priority Data

Nov. 6, 2008 (DE) ..... 10 2008 056 108

(51) Int. Cl.
*B64D 1/04* (2006.01)

(52) U.S. Cl.
USPC ..... 89/1.3; 89/40.02; 89/14.3; 89/42.01; 89/44.01; 89/37.05; 89/1.7; 89/1.702

(58) Field of Classification Search
USPC ..... 89/1.3, 40.02, 14.3, 42.01, 44.01, 89/44.02, 1.7, 1.701, 37.05; 42/1.06, 51; 102/437
See application file for complete search history.

(56) References Cited

U.S. PATENT DOCUMENTS

| | | | | | |
|---|---|---|---|---|---|
| 477,946 | A | * | 6/1892 | Livingston et al. | 89/1.3 |
| 1,445,126 | A | * | 2/1923 | Bergman | 89/1.3 |
| 1,524,273 | A | * | 1/1925 | Newton | 89/1.3 |
| 2,030,507 | A | * | 2/1936 | Driggs | 89/37.02 |
| 2,197,816 | A | * | 4/1940 | Tate | 89/40.02 |
| 2,337,309 | A | * | 12/1943 | Caulkins | 89/1.3 |
| 2,337,647 | A | * | 12/1943 | Caulkins | 89/1.3 |

(Continued)

FOREIGN PATENT DOCUMENTS

| | | |
|---|---|---|
| DE | 31 21 999 A1 | 12/1982 |
| DE | 34 23 010 A1 | 1/1986 |

(Continued)

OTHER PUBLICATIONS

Plastic Deformation at http://www.matter.org.uk/schools/content/hookeslaw/plastic.html, downloaded Apr. 20, 2011, 1 page.

(Continued)

*Primary Examiner* — Michelle Clement
(74) *Attorney, Agent, or Firm* — Griffin & Szipl, P.C.

(57) ABSTRACT

The invention relates to a weapon (1), constructed relatively simply and compactly, for shooting ammunition (2), with a barrel (3) with recoil and a braking device (12) damping the barrel recoil. According to the invention, a plastically deformable absorption body (12) is used as the braking device (12) for reducing the recoil energy. Thus, a weapon assembly for firing ammunition is provided, wherein the weapon assembly includes: (a) a weapon including a weapon barrel provided with a recoil spring that holds the weapon barrel in an initial position; and (b) a braking device that damps barrel recoil of the weapon barrel when firing ammunition, wherein the braking device is a plastically deformable absorption body.

12 Claims, 4 Drawing Sheets

(56) References Cited

U.S. PATENT DOCUMENTS

| | | | | | |
|---|---|---|---|---|---|
| 2,353,971 | A | * | 7/1944 | Shaffer et al. | 42/51 |
| 2,438,165 | A | | 3/1948 | Haas | |
| 2,922,338 | A | | 1/1960 | Barbe | |
| 3,011,407 | A | * | 12/1961 | Van Koningsveld | 89/17 |
| 3,124,070 | A | | 3/1964 | Jasse | |
| 3,208,348 | A | * | 9/1965 | Lee | 89/14.3 |
| 3,326,082 | A | * | 6/1967 | Johnson, Jr. et al. | 89/1.3 |
| 3,501,997 | A | * | 3/1970 | Molnar et al. | 89/44.02 |
| 3,512,449 | A | * | 5/1970 | Stoner | 89/169 |
| 3,672,255 | A | * | 6/1972 | Findlay et al. | 89/42.01 |
| 3,738,219 | A | * | 6/1973 | Febres | 89/1.703 |
| 3,771,417 | A | * | 11/1973 | Schnabele et al. | 89/1.701 |
| 3,800,656 | A | * | 4/1974 | Schnabele | 89/1.701 |
| 3,818,794 | A | | 6/1974 | Mayer et al. | |
| 3,838,622 | A | * | 10/1974 | Febres | 89/1.703 |
| 3,894,473 | A | * | 7/1975 | Marest et al. | 89/37.05 |
| 3,946,637 | A | * | 3/1976 | Campagnuolo et al. | 89/1.3 |
| 4,011,794 | A | * | 3/1977 | Leshem | 89/47 |
| 4,019,423 | A | * | 4/1977 | Johnson | 89/178 |
| 4,022,102 | A | | 5/1977 | Ettel | |
| 4,088,057 | A | * | 5/1978 | Nasypany | 89/1.701 |
| 4,157,054 | A | * | 6/1979 | Cobb | 89/8 |
| 4,172,420 | A | * | 10/1979 | Voss et al. | 102/437 |
| 4,198,897 | A | * | 4/1980 | Lipp et al. | 89/13.05 |
| 4,354,572 | A | | 10/1982 | Martin | |
| 4,406,209 | A | * | 9/1983 | Arene et al. | 89/1.701 |
| 4,489,639 | A | * | 12/1984 | Winkler et al. | 89/37.01 |
| 4,549,487 | A | | 10/1985 | Jensen | |
| 4,583,444 | A | | 4/1986 | Jackson | |
| 4,607,562 | A | | 8/1986 | LeBlanc | |
| 4,616,127 | A | | 10/1986 | Whiting | |
| 4,669,357 | A | | 6/1987 | von Laar et al. | |
| 4,682,528 | A | * | 7/1987 | Wohler | 89/1.3 |
| 4,686,885 | A | | 8/1987 | Bai | |
| 4,711,180 | A | | 12/1987 | Smolnik | |
| 4,721,026 | A | * | 1/1988 | Arana Ibarra | 89/37.05 |
| 4,753,156 | A | * | 6/1988 | Winkler et al. | 89/40.02 |
| 4,898,097 | A | | 2/1990 | Jordan et al. | |
| 4,949,491 | A | * | 8/1990 | Broske | 42/1.06 |
| 4,974,491 | A | | 12/1990 | von Laar et al. | |
| 5,050,479 | A | * | 9/1991 | Heintz et al. | 89/46 |
| 5,123,329 | A | * | 6/1992 | Irwin | 89/161 |
| 5,160,801 | A | | 11/1992 | Andersen et al. | |
| 5,343,795 | A | | 9/1994 | Ziemba et al. | |
| 5,491,917 | A | | 2/1996 | Dilhan et al. | |
| 5,677,507 | A | * | 10/1997 | Becker et al. | 89/47 |
| 5,827,991 | A | * | 10/1998 | Predazzer | 89/161 |
| 6,000,313 | A | | 12/1999 | Becker | |
| 6,095,026 | A | * | 8/2000 | Poussard et al. | 89/46 |
| 6,237,463 | B1 | | 5/2001 | Grizzaffi | |
| 6,286,408 | B1 | | 9/2001 | Sanford et al. | |
| 6,289,780 | B1 | | 9/2001 | Heldmann | |
| 6,457,396 | B1 | | 10/2002 | Bean et al. | |
| 6,460,448 | B1 | * | 10/2002 | Zangrando | 89/45 |
| 6,591,733 | B1 | | 7/2003 | Engstrom | |
| 6,684,547 | B2 | * | 2/2004 | Poff, Jr. | 42/1.06 |
| 6,769,344 | B2 | | 8/2004 | Domeij | |
| 7,124,690 | B1 | | 10/2006 | Tadros et al. | |
| 7,448,306 | B2 | | 11/2008 | Shipman et al. | |
| 7,669,513 | B2 | | 3/2010 | Niv et al. | |
| 8,418,389 | B1 | * | 4/2013 | Lukman et al. | 42/1.06 |
| 2003/0056639 | A1 | * | 3/2003 | Giza | 89/1.701 |
| 2004/0216597 | A1 | | 11/2004 | Kohlstedt et al. | |
| 2005/0268806 | A1 | | 12/2005 | Harjula et al. | |
| 2006/0288857 | A1 | | 12/2006 | Laine | |
| 2007/0074625 | A1 | | 4/2007 | Seidenstricker et al. | |
| 2007/0119296 | A1 | | 5/2007 | Niv et al. | |
| 2007/0241227 | A1 | | 10/2007 | Zemany et al. | |
| 2009/0126558 | A1 | | 5/2009 | Kohnen | |
| 2010/0170128 | A1 | * | 7/2010 | Werner | 42/1.06 |
| 2010/0192439 | A1 | * | 8/2010 | Murello | 42/1.06 |
| 2010/0269681 | A1 | | 10/2010 | Shipman et al. | |
| 2012/0255426 | A1 | | 10/2012 | Reynard et al. | |

FOREIGN PATENT DOCUMENTS

| | | | |
|---|---|---|---|
| DE | 197 13 192 | A1 | 10/1998 |
| DE | 10 2004 050 215 | A1 | 2/2006 |
| DE | 10 2004 050 218 | A1 | 2/2006 |
| DE | 10 2006 014 155 | A1 | 9/2007 |
| DE | 10 2006 029330 | A1 | 12/2007 |
| EP | 0 429 320 | A1 | 5/1991 |
| EP | 0 965 814 | A2 | 12/1999 |
| FR | 2 532 413 | A1 | 3/1984 |
| FR | 2 647 888 | A1 | 12/1990 |
| GB | 2 131 928 | A | 6/1984 |
| GB | 2 325 509 | A | 11/1998 |
| WO | 97/48959 | A1 | 12/1997 |
| WO | 2005/075933 | A1 | 8/2005 |

OTHER PUBLICATIONS

International Search Report issued in corresponding International Application No. PCT/EP2009/007330, completed Dec. 23, 2009, mailed Jan. 11, 2010.

Office Action issued in co-pending related U.S. Appl. No. 13/089,040 on Oct. 23, 2012.

Office Action issued in co-pending related U.S. Appl. No. 13/102,913 on Nov. 7, 2013.

* cited by examiner

WEAPON WITH RECOIL AND BRAKING DEVICE, DAMPING THIS RECOIL

This is a Continuation-in-Part Application in the United States of International Patent Application No. PCT/EP2009/007330 filed Oct. 13, 2009, which claims priority on German Patent Application No. DE 10 2008 056 108.8, filed Nov. 6, 2008. The entire disclosures of the above patent applications are hereby incorporated by reference.

FIELD OF THE INVENTION

The invention relates to a weapon for firing ammunition having a weapon barrel with recoil, and having a braking device that damps the barrel recoil.

BACKGROUND OF THE INVENTION

Large-caliber guns, in particular, generally have hydraulic braking systems at the rear, such as a braking device for damping the barrel recoil; however, these hydraulic braking systems are relatively voluminous and costly. By way of example, DE 10 2006 014 155 A1 describes one such hydro-pneumatic braking and recoil system for recoiling guns.

If the aim is to design guns to be as simple as possible, as is the case for mortars and grenade launchers, etc., a rigid barrel bearing is normally preferred, in which the forces that occur during firing are transmitted via a rigid baseplate downward to the ground (See, e.g., DE 197 13 192 C2). However, small aircraft, helicopters or light weight vehicles, in particular, cannot be fitted with such mortars because of the high gas recoil forces generated on firing.

The present invention is based on the object of specifying a weapon that is relatively simple and compact, despite the use of a weapon barrel with recoil and despite the use of a braking device that damps the barrel recoil.

SUMMARY OF THE INVENTION

According to the invention, this object is achieved by the features of first embodiment directed to a weapon for firing ammunition (2), wherein the weapon has a weapon barrel (3) with recoil and having a braking device (12) that damps the barrel recoil, characterized in that the braking device (12) is a plastically deformable absorption body. Further, particularly advantageous refinements of the invention are disclosed in the following additional embodiments.

For example, in accordance with a second embodiment of the present invention, the first embodiment is modified so that the absorption body (12) consists of a metal foam. In accordance with a third embodiment of the present invention, the first embodiment is modified so that the absorption body (12) consists of a honeycomb structure and of metal sheets. In accordance with a fourth embodiment of the present invention, the first embodiment, the second embodiment and the third embodiment are further modified so that the absorption body (12) is a part of the packaging, the entire packaging of the respective ammunition (2) to be fired, or a separate part that is attached to the packaging (12).

In accordance with a fifth embodiment of the present invention, the first embodiment, the second embodiment, and the third embodiment are further modified so that, in the case of a weapon (1) for firing cartridge ammunition, the absorption body is the cartridge case of the ammunition. In accordance with a sixth embodiment of the present invention, the first embodiment, the second embodiment, the third embodiment, and the fourth embodiment, are further modified so that the weapon (1) has a chamber (11), for replaceably accommodating the absorption body (12), in the area adjacent at the rear to the weapon barrel (3) in its initial position. In accordance with a seventh embodiment of the present invention, the first embodiment, the second embodiment, the third embodiment, the fourth embodiment, the fifth embodiment, and the sixth embodiment, are further modified so that the weapon (1) is a mortar which has a barrel guide (4) which, at the rear, has a chamber (11) which is open at the top and/or at the side, and into which the absorption body (12) can be inserted, and from which the absorption body (12) can also be removed again.

The invention is essentially based on the idea of not using a hydraulic brake as a braking device for dissipating the recoil energy, but using a plastically deformable absorption body, which is a type of component for energy absorption. By way of example, the absorption body may consist of a metal foam (for example, aluminum or steel foam) or of a honeycomb structure and of metal sheets.

In order that the absorption body is available whenever the weapon is reloaded, it has been found to be advantageous for the absorption body to be a part of the packaging, such as either the entire packaging of the respective ammunition to be fired or as a separate part that is attached to the packaging of the respective ammunition to be fired.

In the case of a weapon for firing cartridge ammunition, the absorption body may, however, also be the cartridge case of the ammunition. In one particularly advantageous embodiment of the invention, the weapon is a mortar that has a barrel guide which, at the rear, has a chamber that is open at the top and/or at the side, and into which the absorption body can be inserted, and from which the absorption body can also be removed again.

BRIEF DESCRIPTION OF THE DRAWINGS

Further details and advantages of the invention will become evident from the following exemplary embodiments, which will be explained with reference to the figures, in which.

DETAILED DESCRIPTION OF THE INVENTION

Figure 1:
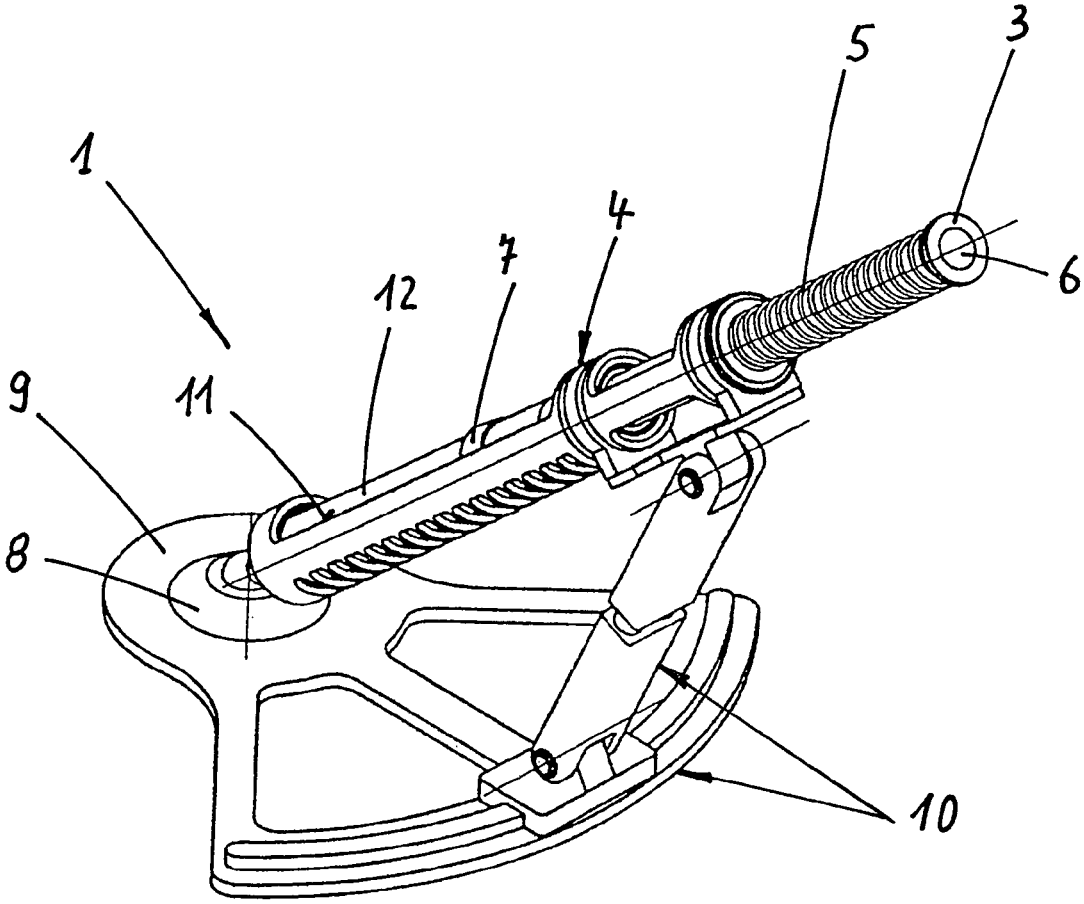
FIG. 1 shows a perspective view of a mortar according to the invention.
Figure 2:
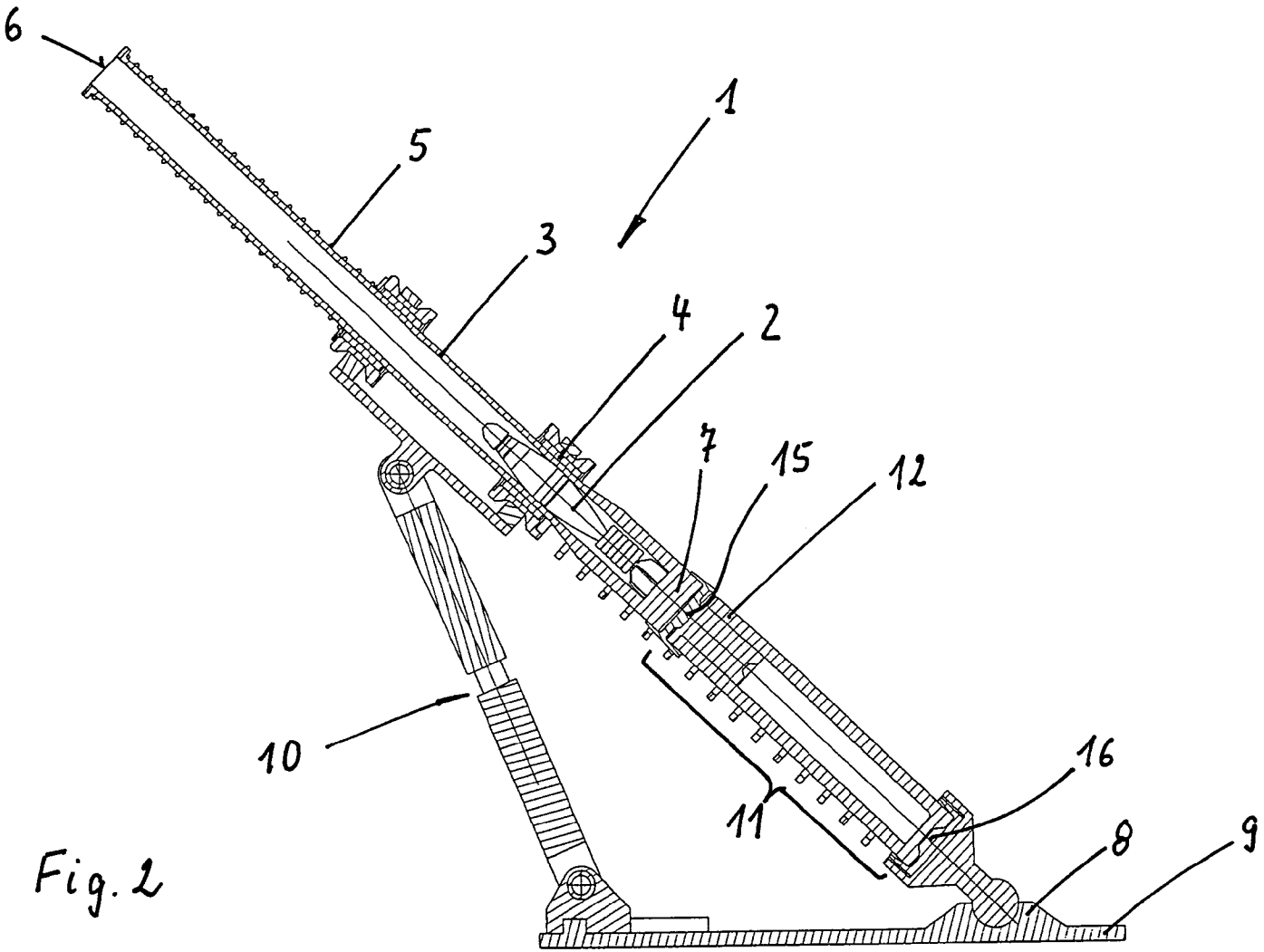
FIG. 2 shows a longitudinal section through the mortar illustrated in FIG. 1, with a shell loaded, shortly before it is fired.
Figure 3:
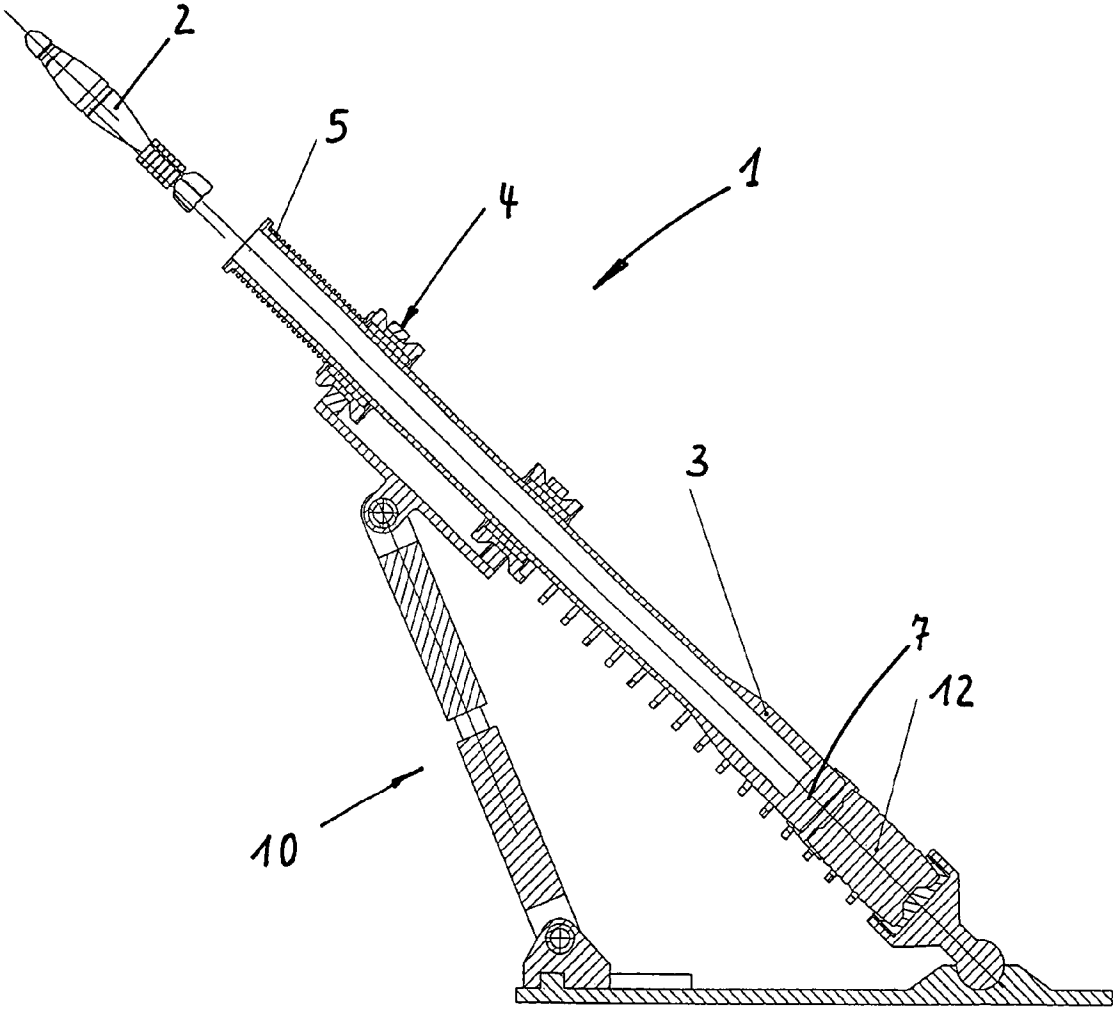
FIG. 3 shows an illustration corresponding to FIG. 2, but after firing of the shell and deformation of the absorption body.

In FIGS. 1 to 3, 1 denotes a mortar for firing shells 2. The mortar 1 comprises a weapon barrel 3, which is mounted in a barrel guide 4 so that the weapon barrel 3 can be moved axially. The weapon barrel 3 is held in an initial position (See FIGS. 1 and 2) by, for example, a recoil spring 5 (or the like), which is supported at one end on the weapon barrel 3, which in this case, by way of example, is on or at the muzzle 6, and at the other end on the barrel guide 4. A breech 7, provided with a corresponding firing device (not illustrated) for firing the shell 2, is arranged at the rear end of the weapon barrel 3.

The barrel guide 4 extends as far as an opposing bearing, which essentially comprises a ball socket 8 and a baseplate 9, and can be positioned automatically or manually by means of an aiming system 10, for elevation and azimuth aiming of the weapon barrel. In addition, the barrel guide 4 has, at the rear, a chamber 11, which is open at the top, for accommodating a replaceable braking device 12, which damps the barrel recoil. According to the invention, this braking device 12 is a plastic deformable absorption body, for example, consisting of a metal foam.

Figure 4:
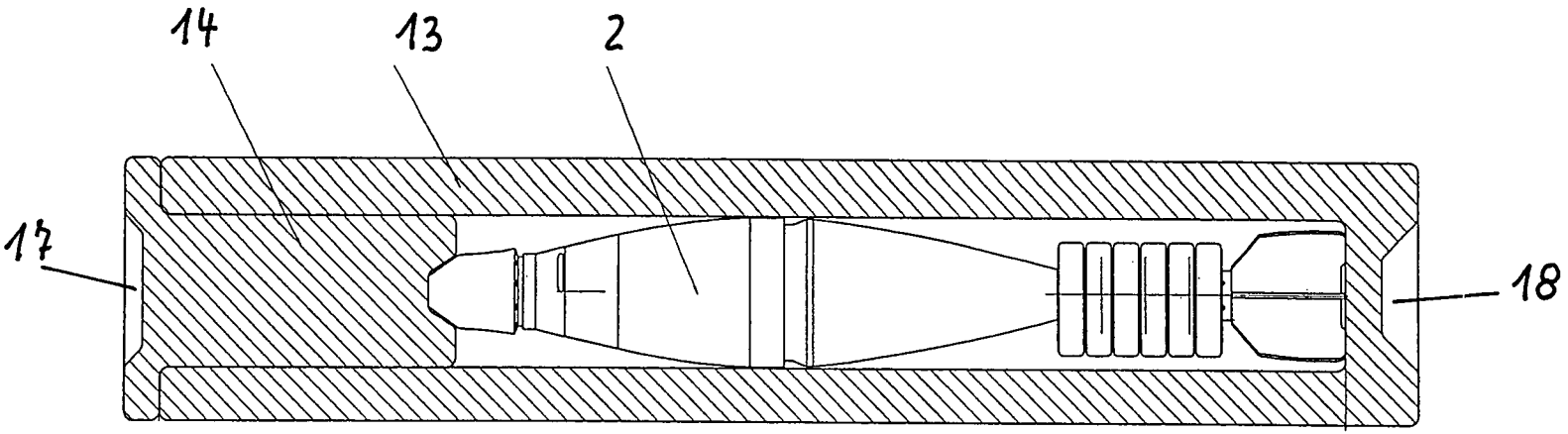
FIG. 4 shows a shell in its packaging, which can be used as an absorption body, in accordance with the present invention.

In the exemplary embodiment illustrated in FIGS. 1 to 3, the absorption body 12 is the packaging of the shell 2 to be fired (See FIG. 4).

FIG. 4 shows corresponding packaging 12 with a shell 2 located in it. The packaging 12 consists essentially of a metal foam sleeve 13 and a metal foam cover 14 which is matched to the length of the shell 2. In order to fire the shell 2, the shell 2 is first of all removed from the packaging 12. The entire packaging 12 is then inserted into the chamber 11 in the barrel guide 4, with centering elements 15, 16 of the barrel guide 4 engaging in corresponding recesses 17, 18 formed in the end faces of the packaging 12. The shell 2 is then inserted into the weapon barrel 3 from the muzzle 6 of the weapon barrel 3, and slides to the breech end of the weapon barrel 3 (See FIG. 2). As soon as the fuze of the shell 2 strikes the firing device of the breech 7, the propellant charge of the shell 2 is fired and the shell 2 is accelerated, by means of the propellant charge gasses, toward the muzzle 6 of the weapon barrel 3.

During firing, the recoil forces at the same time force the weapon barrel 3 in the direction of the opposing bearing 8, 9, as a result of which, on the one hand, the recoil spring 5 is stressed and, on the other hand, the absorption body 12 is plastically (and therefore irreversibly) deformed (See FIG. 3). Once the shell 2 has left the weapon barrel 3 and the barrel recoil has ended, the recoil spring 5 forces the weapon barrel 3 back to its initial position (shown in FIG. 2) from the recoil position (shown in FIG. 3), and the plastically deformed absorption body 12 can be manually removed from the chamber 11 or, possibly, can be ejected by means of an ejection device.

As shown in FIGS. 2 and 3, the weapon 1 and the ammunition packaging 12 form a weapon assembly, wherein the packaging is removable and replaceable separate from the weapon 1. In this way, for each round of ammunition fired, the shell packaging 12 is inserted into the weapon 1 in order to serve as the absorption body, which is plastically deformed by weapon barrel recoil during firing. The plastically deformed packaging is then removed from the weapon 1 and replaced with another fresh packaging corresponding to the next shell to be fired. This fresh packaging is deformed during firing of the next shell, and then is removed and replaceable with yet another fresh packaging so that the weapon is ready to fire again when loaded with still another shell.

LIST OF REFERENCE SYMBOLS

1 Weapon, mortar
2 Shell, ammunition
3 Weapon barrel
4 Barrel guide
5 Recoil spring
6 Muzzle
7 Breech
8 Ball socket
9 Baseplate
10 Aiming system
11 Chamber
12 Braking device, absorption body, packaging
13 Metal foam sleeve
14 Metal foam cover
15, 16 Centering elements
17, 18 Recesses

The invention claimed is:

1. A weapon assembly for firing ammunition, comprising:
(a) a weapon including a weapon barrel provided with a recoil spring that holds the weapon barrel in an initial position; and
(b) a braking device that damps barrel recoil of the weapon barrel when firing ammunition, wherein the braking device is a plastically deformable absorption body, wherein the weapon is adapted to fire cartridge ammunition comprising a cartridge case, and the absorption body is the cartridge case of the cartridge ammunition.

2. The weapon assembly as claimed in claim 1, wherein the absorption body comprises a metal foam.

3. The weapon assembly as claimed in claim 1, wherein the absorption body comprises a honeycomb structure and metal sheets.

4. The weapon assembly as claimed in claim 1, wherein the weapon has a chamber located in an area adjacent a rear of the weapon barrel when the weapon barrel is in the initial position, wherein the chamber is configured to replaceably accommodate the absorption body.

5. The weapon assembly as claimed in claim 1, wherein the weapon is a mortar.

6. A weapon for firing ammunition, comprising:
(a) a weapon barrel provided with a recoil spring that holds the weapon barrel in an initial position; and
(b) a braking device that damps barrel recoil of the weapon barrel when firing ammunition, wherein the braking device is a plastically deformable absorption body, and wherein the weapon is a mortar and the absorption body is ammunition packaging.

7. The weapon assembly as claimed in claim 6, wherein the absorption body forms a part of packaging of the ammunition to be fired, either the entire packaging of the ammunition or a separate part that is attached to the rest of the packaging of the ammunition.

8. The weapon assembly as claimed in claim 6, wherein the weapon is adapted to fire cartridge ammunition comprising a cartridge case, and the absorption body is the cartridge case of the cartridge ammunition.

9. A weapon assembly for firing ammunition, comprising:
(a) a weapon including a weapon barrel provided with a recoil spring that holds the weapon barrel in an initial position; and
(b) a braking device that damps barrel recoil of the weapon barrel when firing ammunition, wherein the braking device is a plastically deformable absorption body, and wherein the absorption body forms a part of packaging of the ammunition to be fired, either the entire packaging of the ammunition or a separate part that is attached to the rest of the packaging of the ammunition.

10. The weapon assembly as claimed in claim 9, wherein the weapon is adapted to fire cartridge ammunition comprising a cartridge case, the absorption body is the cartridge case of the cartridge ammunition.

11. A weapon assembly for firing ammunition, comprising:
(a) a weapon including a weapon barrel provided with a recoil spring that holds the weapon barrel in an initial position; and
(b) a braking device that damps barrel recoil of the weapon barrel when firing ammunition, wherein the braking device is a plastically deformable absorption body, and wherein the weapon is a mortar that has a barrel guide, wherein the barrel guide has a chamber at a rear, wherein the chamber is open at a top, or is open at a side, or is open at the top and at the side, and the absorption body is insertable into the chamber, and the absorption body is also removeable from the chamber again.

12. The weapon assembly as claimed in claim 11, wherein the absorption body forms a part of packaging of the ammunition to be fired, either the entire packaging of the ammunition or a separate part that is attached to the rest of the packaging of the ammunition.

* * * * *